United States Patent [19]

Gannaway

[11] 3,934,967

[45] Jan. 27, 1976

[54] REFRIGERATION COMPRESSOR AND SYSTEM

[75] Inventor: Edwin L. Gannaway, Adrian, Mich.

[73] Assignee: Sundstrand Corporation, Rockford, Ill.

[22] Filed: July 12, 1973

[21] Appl. No.: 379,006

[52] U.S. Cl. ..... 417/271; 417/312

[51] Int. Cl.[2] ..... F04B 27/00

[58] Field of Search ..... 417/269, 271, 457, 458, 417/564, 550, 312, 366; 181/57, 36 R, 47 A

[56] References Cited

UNITED STATES PATENTS

| | | | |
|---|---|---|---|
| 2,093,477 | 9/1937 | Parsons | 417/269 |
| 2,792,789 | 5/1957 | Mizen | 417/269 |
| 2,792,790 | 5/1957 | Capps | 417/550 |
| 2,846,140 | 8/1958 | Kemper | 417/458 |
| 2,948,461 | 8/1960 | Frank | 181/36 R |
| 2,968,961 | 1/1961 | McGregor | 417/271 |
| 3,006,160 | 10/1961 | Heidorn | 181/57 |
| 3,146,605 | 9/1964 | Rachfal | 417/366 |
| 3,663,122 | 5/1972 | Kitchen | 417/269 |
| 3,675,732 | 7/1972 | Rosen et al. | 181/57 |

*Primary Examiner*—William L. Freeh
*Assistant Examiner*—G. P. LaPointe
*Attorney, Agent, or Firm*—Wegner, Stellman, McCord, Wiles & Wood

[57] ABSTRACT

A refrigeration compressor including a sealed housing with a stationary cylinder block having an annular array of axial cylinders, pistons reciprocable in the cylinders, a rotatable cam for reciprocating the pistons, an annular inlet channel around the cylinder block, intake valving for admitting fluid from the inlet channel to the cylinders on the intake strokes of the pistons, outlet valving for discharging high pressure fluid from the cylinders on the compression strokes of the pistons, and a baffle mounted on the end of the cylinder block over the outlet valving. The compressor is utilized in a system including an electric motor in the housing connected for rotating the cam, a desuperheater communicating with high pressure vapor from the outlet valving for cooling the vapor, means for supplying cooled vapor from the desuperheater to the housing for cooling the electric motor, a condenser for receiving vapor after circulation through the motor, an evaporator communicating with the condenser, and means for supplying vapor from the evaporator to the intake valving.

9 Claims, 4 Drawing Figures

TO DESUPERHEATER
FROM EVAPORATOR
TO CONDENSER
FROM DESUPER-HEATER

REFRIGERATION COMPRESSOR AND SYSTEM

BACKGROUND OF THE INVENTION

This invention relates to a refrigeration compressor with a driving electric motor mounted in the same housing. In the past, it has been conventional practice to mount the compressor and the motor in a single hermetically sealed housing in an arrangement providing for circulation of incoming vapor through the electric motor for purposes of cooling the motor before the vapor is drawn into the compressor. Generally speaking, it is desirable to supply intake vapor from the evaporator to the compressor at a temperature as low as possible. When the intake gas is supplied to the compressor through the electric motor, the heat transferred to the vapor in cooling the motor elevates the temperature of the intake vapor supplied to the compressor. In order to supply intake vapor to the compressor at low temperature, it is desirable to supply intake vapor from the evaporator directly to the compressor inlet and to take the heat out of the motor without utilizing intake vapor between the evaporator and the compressor.

SUMMARY OF THE PRESENT INVENTION

It is a general object of the present invention to provide a new and improved compressor construction including a cylinder block with an annular array of axially disposed cylinders having reciprocable pistons actuated by a relatively rotatable cam, in an arrangement including an annular intake chamber around the cylinder block communicating directly with an inlet to the housing and communicating directly with the compressor cylinders.

A more specific object is to provide a new and improved axial piston refrigeration compressor of the type described including intake valving in the pistons for admitting fluid from the annular inlet channel to the cylinders on intake strokes of the pistons, together with axially directed outlet porting from the cylinder block controlled by outlet valving for discharging high pressure fluid from the cylinders on the compression strokes of the pistons.

Another object is to provide a new and improved axial piston refrigeration compressor of the character mentioned including a circular baffle disc over the outlet valving at the end of the cylinder block for controlling flow of vapor from the cylinders to the outlet from the housing.

In a preferred construction, the baffle is made of resiliently flexible steel material and has a dish-shaped configuration with a central portion secured in spaced relation to the cylinder block and an outer periphery which is resiliently yieldable relative to outlet passages leading from beneath the baffle to an outlet chamber in the compressor housing.

Another object of the invention is to provide a new and improved refrigeration compressor utilizing a housing having a sealed compression chamber and a separate sealed motor chamber, so that incoming vapor may be supplied directly from the evaporator to the compressor intake, and cooling vapor may be supplied to the electric motor chamber separately for purposes of cooling the motor without heating the vapor between the evaporator and the compressor.

Another object is to provide a new and improved refrigeration system in which high pressure vapor is supplied from the compressor outlet to a desuperheater where the vapor is cooled for supply to the motor chamber for cooling the motor during passage of the vapor to the condenser. From the condenser, the condensed liquid is supplied to an evaporator from which the vapor is transmitted directly to the compressor inlet.

DETAILED DESCRIPTION OF PREFERRED EMBODIMENT

Figure 1:
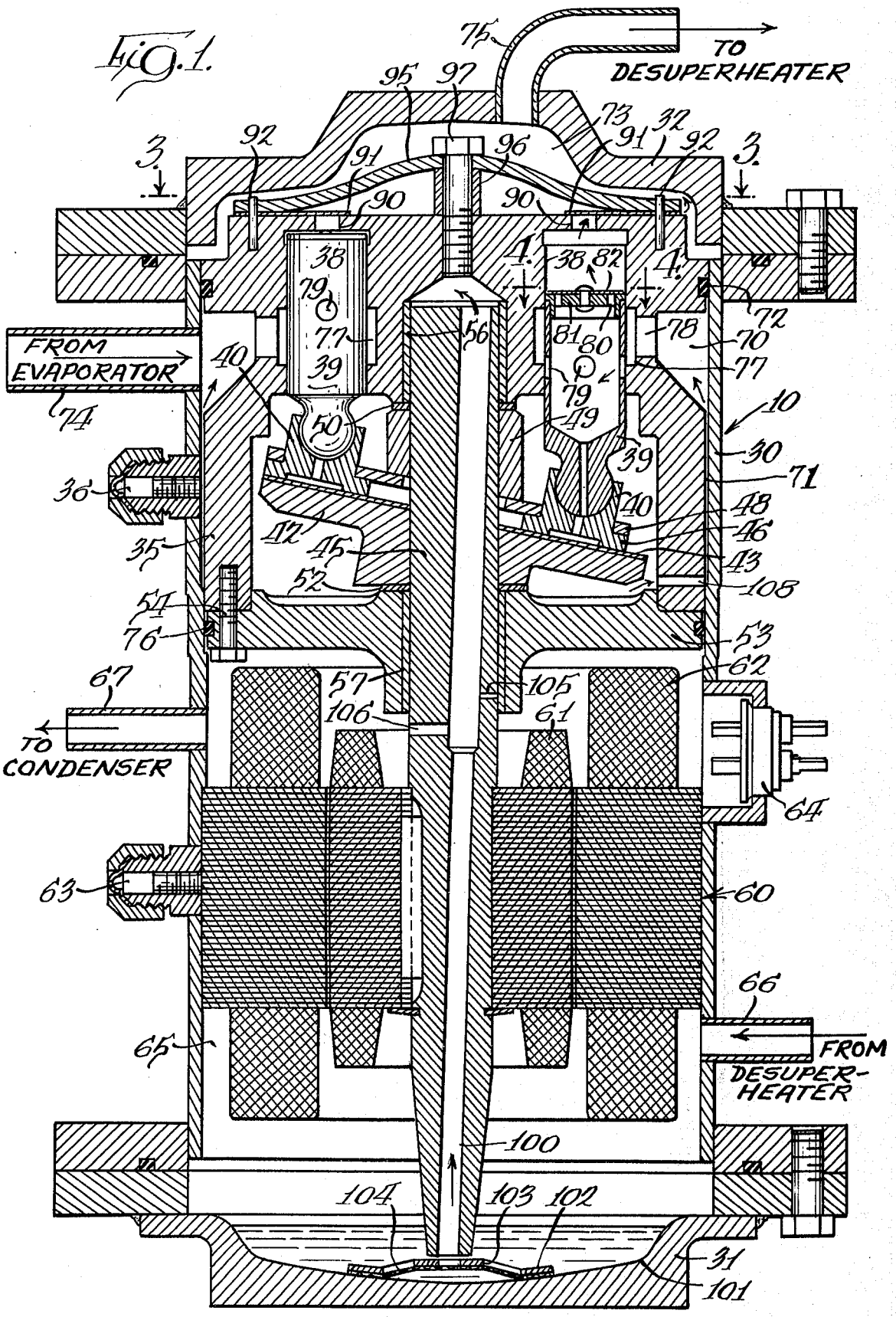
FIG. 1 is a longitudinal sectional view through an axial piston refrigeration compressor embodying the principles of the present invention.

Referring now to the drawings in more detail, the invention is embodied in a refrigeration system including a compressor 10 (illustrated in detail in FIG. 1 and shown diagrammatically in FIG. 2), which supplies high pressure refrigerant vapor through a line 12 to a desuperheater 14 where the vapor is cooled from a temperature on the order of 250°F. down to a temperature on the order of 130°F. The cooled vapor is supplied through a line 16 to an electric motor chamber in the compressor 10 for cooling the motor to permit operation at increased load without overheating. The vapor is discharged from the motor housing through a line 18 leading to a condenser 20. In the condenser, the vapor is condensed at approximately 25° above ambient temperature, and the liquid temperature is lowered to a value on the order of 10°F. above ambient temperature. For example, if the ambient temperature is at about 95°F., the liquid is discharged from the condenser at approximately 105°F. The liquid is discharged from the condenser 20 to a line 22 including a capillary restriction 24. The line 22 leads to an evaporator 26 from which the vapor is returned to the compressor 10.

The capillary restriction 24 is preferably in the form of a tube which allows enough liquid to pass to make up for that which is vaporized in the evaporator 26 as the compressor operates. The capillary restriction reduces the pressure of the liquid refrigerant to an evaporating pressure. In the first part of the capillary tube, there is little change in the liquid except a slight drop in pressure. Toward the end of the capillary tube, the pressure drops significantly and the liquid tends to expand, but complete evaporization does not occur until the refrigerant passes through the evaporator. The temperature at the exit end of the capillary tube may be on the order of 45°F. In the evaporator, the temperature is elevated to about 65°F. In an air conditioning system where air is circulated through the evaporator, the temperature of the air discharged from the evaporator may be approximately 75°F.

Figure 2:
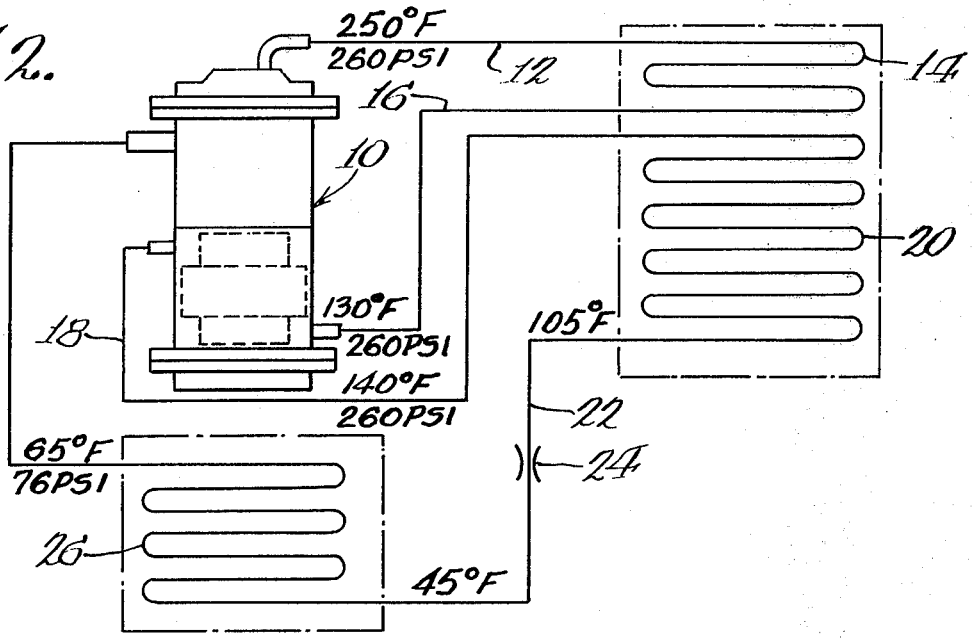
FIG. 2 is a diagrammatic illustration of a refrigeration system embodying the principles of the present invention.
Figure 3:
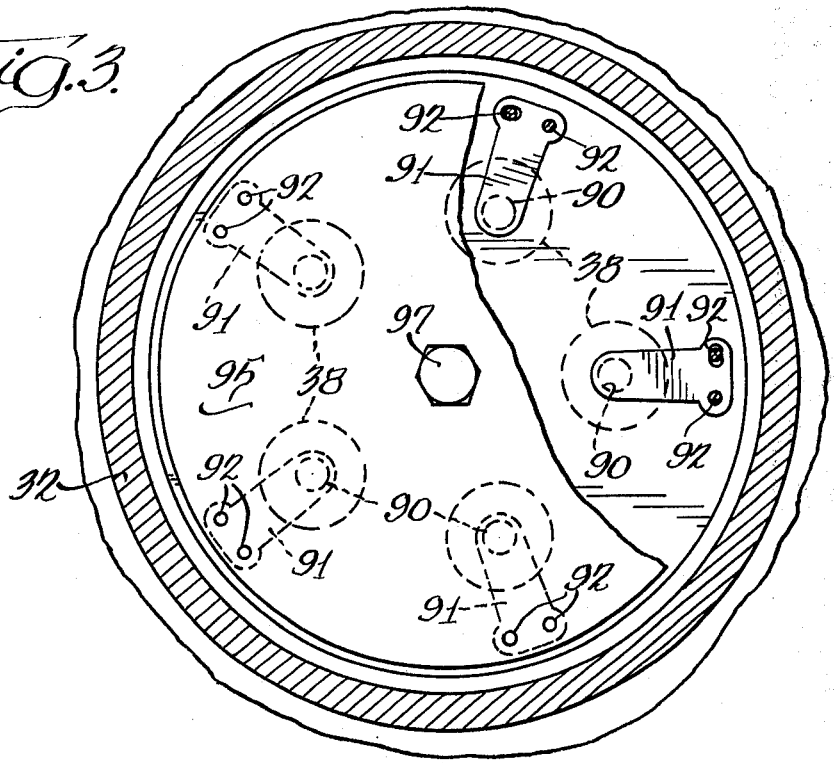
FIG. 3 is a transverse cross-sectional view taken at about the line 3—3 of FIG. 1.

Referring particularly to FIG. 1, the compressor 10 includes a generally cylindrical housing 30 which is closed at the lower end by an end cover 31 and which is closed at the upper end by an end cover 32 in a manner to provide a hermetically sealed enclosure. In the upper end of the housing 30, a cylinder block 35 is secured in position by means such as set screws 36 or a press fit. The cylinder block 35 is formed with an annular series of axially disposed cylinders 38 which are arranged concentrically around the central axis of the cylinder block. The cylinders 38 house reciprocable pistons 39 on the outer ends of which there are universally mounted bearing slippers 40 engageable with a cam or wobbler 42 having an inclined thrust surface 43 engageable with the bearing slippers 40. The cylinder block 35 is stationarily mounted, and the wobbler 42 is secured to a drive shaft 45 to rotate with the drive shaft to drive the pistons 39 through compression strokes.

The bearing slippers 40 on the pistons pull the pistons through intake strokes. For this purpose, the outer end of each bearing slipper includes an enlarged annular flange 46 engaged by a holddown plate 48 which in turn engages a thrust collar 49 on the drive shaft 45 engaging a thrust bearing 50 abutting a central portion of the cylinder block 35. The wobbler 42 is supported by a thrust bearing 52 on a bearing plate 53 which is secured to the cylinder block 35 by bolts or screws as illustrated at 54. The cylinder block 35 includes a bearing 56 for the upper end of the drive shaft 45, and the bearing plate 53 includes a bearing 57 for an intermediate portion of the drive shaft. In operation, rotation of the drive shaft causes rotation of the wobbler 42. As the wobbler rotates, it drives the pistons 39 through compression strokes, and the holddown plate 48 pulls the pistons through intake strokes.

The drive shaft 45 is driven by an electric motor 60 in the lower part of the cylindrical housing 30. The motor includes a rotor 61 secured to the shaft 45 to rotate therewith, and a stator 62 which is stationarily mounted in the housing 30 as by set screws illustrated at 63 or a press fit to the housing. Electric power is supplied to the motor through a plug 64 accessible on the outside of the housing 30. The motor 60 is located in an isolated motor chamber 65 which is sealed from the upper part of the housing containing the cylinder block 35 by means of a sealing ring 76 surrounding the outer periphery of the bearing plate 53 and engaging the inner surface of the housing 30. In this manner, the motor chamber 65 is isolated from the compressor intake, and the motor may be cooled by compressed vapor from the compressor outlet rather than by suction vapor in the path to the compressor inlet. For the purpose of admitting vapor to the motor chamber 65 from the desuperheater 14 and the conduit 16, the housing includes a vapor inlet 66. Vapor admitted through the inlet 66 is circulated through the motor 60 and is discharged from the housing through an outlet 67 leading to the conduit 18 and the condenser 20.

The cylinder block 35 is formed on the outside with a surrounding annular compressor intake channel 70 which is isolated in a sealed compressor intake chamber 71, closed at the bottom end of the cylinder block by the sealing ring 76 and closed at the top of the cylinder block by a similar sealing ring 72 around the block. The ring 72 separates the intake chamber from an outlet chamber 73 formed between the upper end of the cylinder block 35 and the upper end closure member 32. An inlet 74 leads from the evaporator to the intake channel 70, and an outlet 75 leads from the discharge chamber 73 to the conduit 12 and the desuperheater 14.

Figure 4:
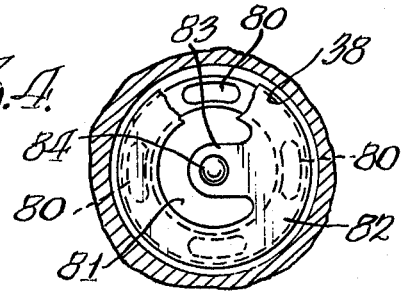
FIG. 4 is a fragmentary sectional view taken at about the line 4—4 of FIG. 1.

In order to admit fluid to the cylinders 38 on the intake strokes of the pistons 39, each of the cylinders is formed with a centrally located annular groove 77 communicating through a radial port 78 with the annular intake channel 70. In order to admit vapor from the annular grooves 77 to the ends of the pistons 39, each of the pistons is of hollow construction and is formed with intake porting and intake valving. The intake porting includes radial ports 79 through the cylindrical wall of the hollow piston, and axial ports 80 through an end closure 81 in the end of each piston. As illustrated in FIGS. 1 and 4, the axial ports 80 are controlled by a resiliently flexible leaf valve member in the form of an annular ring 82 having a central tongue 83 secured at 84 to the closure 81 in the end of the piston. In operation, during the intake stroke of the piston, the annular valve member 82 is lifted off the ports 80 to admit vapor to the end of the piston in the cylinder 38.

In order to exhaust compressed vapor from the cylinders 38, axial ports 90 are formed in the end of the cylinder block, respectively communicating the cylinders 38 with the discharge chamber 73. The discharge ports 90 are controlled by individual leaf valve members 91 each having an outer end portion located by means of dowel pins 92 in the cylinder block and an inner end portion disposed over the associated port 90. During intake strokes of the pistons, the valve members 91 lie flat against the end of the cylinder block, closing the ports 90. During the compression strokes of the pistons 39, the valve members 91 are lifted off the ports 90 to permit discharge of compressed vapor to the chamber 73.

In order to control vibration and reduce noise associated with discharge of high pressure vapor from the cylinders 38, a circular baffle disc 95 is secured to the end of the cylinder block 35. The baffle is dish-shaped and includes a central portion supported on an annular spacer 96 and an outer periphery located by the dowel pins 92. The central portion of the baffle is secured in place by a bolt or screw as at 97, and the baffle is made of resiliently flexible steel material so that the outer periphery of the baffle is movable relative to the end of the cylinder block 35. Under normal conditions of operation, the outer portion of the baffle 95 lies against the outlet valve members 91 and discharge passages from the baffle chamber are provided by the spaces between the valve members 91. Under unusual conditions, as when the compressor might pump liquid on initial starting operation, the baffle may lift off the end of the cylinder block to relieve excessive high pressure. During normal operation, the baffle member prevents impingement of high pressure discharge vapor against the end cover member 32, thereby reducing vibration and muffling noise.

In order to provide for appropriate lubrication of the compressor, the drive shaft 45 is formed with a longitudinal passage 100 which is inclined relative to the axis of the shaft and which has a lower portion extending into the lower end cover member 31 where lubricating oil is provided in a sump 101. The sump includes a circular baffle 102 having apertures 103 covered by a filter screen 104 for admitting lubricating oil to the longitudinal passage 100 in the drive shaft 45. Rotation of the shaft 45 in the lubricating oil results in drawing fluid into the passage 100 and distributing the fluid upwardly in the passage to a lubricating port as at 105 for oiling the bearing 57. The passage 100 continues upwardly to the upper end of the shaft 45 where lubricating fluid is also distributed to the upper shaft bearing 56. In order to avoid vapor lock in the passage 100 in the shaft 45, the shaft is preferably formed with a vent as at 106 leading laterally from the passage 100 to the interior of the motor chamber 65. On shutdown, in the event of high pressure in the lower portion of the motor chamber, the vent 106 functions to relieve such pressure and avoid forcing excessive lubricating fluid upwardly into the compressor. Lubricating fluid flowing past the bearings 56 and 57 into the chamber housing the cam 42 is drained through a port 108 in the cylinder block communicating with intake chamber 71. In operation, some lubricating fluid may become entrained in the compressor discharge vapor and be circulated through the desuperheater into the motor chamber 65. In such event, when the vapor loses velocity on entry into the chamber 65, the oil drops out of the vapor into the sump 101.

In operation, vapor from the evaporator is introduced into the compressor cylinders through the inlet channel 70 without circulation through the electric drive motor and without significant circulation through the compressor structure so that intake gas is introduced to the compressor at a temperature as low as possible, thereby to improve the efficiency of the system. Introduction of incoming vapor from the desuperheater for cooling the motor, rather than using intake vapor for cooling the motor results in introduction of vapor to the cylinders with a minimum heat loss after evaporation, resulting in improved efficiency on the order of 20% to 25%. The baffle associated with the outlet valving provides for continuous gas flow from the multiple cylinders while reducing vibration and noise and at the same time allowing relief of excess pressures.

I claim:

1. A refrigeration compressor, comprising, a. a sealed housing, b. a cylinder block in the housing having an annular array of parallel axially disposed cylinders around a central axis, c. pistons reciprocable in the cylinders, d. a cam inclined relative to the axis of the cylinder block, e. means mounting the cam and the cylinder block for relative rotation to reciprocate the pistons in the cylinders, f. means providing an annular inlet channel in the housing around the cylinder block, g. an inlet in the housing leading to the annular channel, h. intake valving for admitting low pressure fluid from the inlet channel to the cylinders on the intake strokes of the pistons, i. an outlet leading from the housing, j. an annular array of outlet ports in the cylinder block leading axially respectively from the cylinders to the outlet, k. leaf valves associated with the outlet ports for discharging high pressure fluid from the cylinders to the outlet on the compression strokes of the pistons, and l. a circular dish-shaped baffle having a central portion in spaced relation to the cylinder block and an outer periphery overlying and contiguous with the leaf valves and defining restricted passages between the leaf valves from the interior of the baffle to the outlet.

2. The refrigeration compressor of claim 1 wherein the baffle member is resiliently yieldable so that the outer periphery is movable relative to the end of the cylinder block to relieve pressure under the baffle.

3. The refrigeration compressor of claim 1 in which the central portion of the baffle is secured to the cylinder block and the outer periphery is free.

4. The refrigeration compressor of claim 3 in which the baffle member is resiliently yieldable so that the outer periphery is movable relative to the end of the cylinder block to relieve pressure under the baffle.

5. The refrigeration compressor of claim 4 including a dowel pin extending axially from the end of the block adjacent each outlet port, each leaf valve having an end portion through the dowel pin extending therethrough, and the periphery of the baffle plate overlying the end portions of the valves with the dowel pints extending therethrough.

6. A refrigeration compressor, comprising, a. a sealed housing, b. a cylinder block in the housing having an annular array of parallel axially disposed cylinders around a central axis, c. pistons reciprocable in the cylinders, d. a cam inclined relative to the axis of the cylinder block, e. means mounting the cam and the cylinder block for relative rotation to reciprocate the pistons in the cylinders, f. means providing an inlet chamber in the housing, g. intake valving for admitting low pressure fluid from the inlet chamber to the cylinders on the intake strokes of the pistons, h. an outlet chamber in the housing at the end of the cylinder block opposite from the cam, i. outlet ports leading axially respectively from the cylinders to the outlet chamber, j. leaf valves associated with the outlet ports for discharging high pressure fluid from the cylinders to the outlet on the compression strokes of the pistons, and k. a circular dish-shaped baffle having a central portion in spaced relation to the cylinder block and an outer periphery overlying and contiguous with the leaf valves and defining restricted passages between the leaf valves from the interior of the baffle to the outlet.

7. A refrigeration compressor as defined in claim 6, wherein the baffle member is resiliently yieldable so that the outer periphery is movable relative to the end of the cylinder block to relieve pressure under the baffle.

8. A refrigeration compressor, comprising, a. a sealed housing, b. a stationary cylinder block in the housing having an annular array of parallel axially disposed cylinders around a central axis, c. pistons reciprocable in the cylinders, d. a rotatable cam having a cam surface inclined relative to the axis of the cylinder block, e. bearing means on the pistons engageable with the cam surface, f. means for holding the bearing means on the inclined cam surface, g. means providing an inlet chamber in the housing, h. intake valving for admitting low pressure fluid from the inlet chamber to the cylinders on the intake strokes of the pistons, i. an end cover on the housing forming an outlet chamber at the end of the cylinder block opposite from the cam, j. an outlet in the end cover leading from the outlet chamber, k. an annular array of outlet ports in the cylinder block leading axially respectively from the cylinders to the outlet chamber, l. leaf valves associated with the outlet ports for discharging high pressure fluid from the cylinders to the outlet chamber on the compression strokes of the pistons, and m. a circular dish-shaped baffle having a central portion secured in spaced relation to the cylinder block and an outer periphery overlying and contiguous with the leaf valves and defining restricted passages between the leaf valves from the interior of the baffle to the outlet chamber.

9. A refrigeration compressor as defined in claim 8, wherein the baffle is resiliently yieldable so that the outer periphery is movable axially away from the cylinder block to relieve excess pressure.

* * * * *